United States Patent [19]

Rozendaal

[11] Patent Number: 4,853,045

[45] Date of Patent: Aug. 1, 1989

[54] METHOD FOR THE MANUFACTURE OF RARE EARTH TRANSITION METAL ALLOY MAGNETS

[75] Inventor: Ewoud Rozendaal, Southport, England

[73] Assignee: U.S. Philips Corporation, New York, N.Y.

[21] Appl. No.: 159,820

[22] Filed: Feb. 24, 1988

[30] Foreign Application Priority Data

Feb. 27, 1987 [GB] United Kingdom ..... 8704713

[51] Int. Cl.[4] ..... H01F 1/02

[52] U.S. Cl. ..... 148/103; 148/104; 75/0.5 R; 75/0.5 BA; 419/12; 419/33

[58] Field of Search ..... 148/101, 103, 108, 104, 148/105, 302; 75/0.5 R, 0.5 BA; 419/12, 33; 420/83, 121

[56] References Cited

U.S. PATENT DOCUMENTS 4,663,066 5/1987 Fruchart et al. ..... 148/302

FOREIGN PATENT DOCUMENTS 60-63304 4/1985 Japan .
60-119701 6/1985 Japan .
61-139603 6/1986 Japan ..... 148/101
1554384 10/1979 United Kingdom .

OTHER PUBLICATIONS

McGuiness et al., "The Production of a Nd-Fe-B Permanent Magnet by Hydrogen Decrepitation/Attritor Milling Route", J. of Materials Science, 21 (1986), 4107–4110.

Harris et al., "The Hydrogen Decrepitation of an $Nd_{15}Fe_{77}B_8$ Magnetic Alloy" J. of the Less-Common Metals, 106 (1985), L1 to L4.

*Primary Examiner*—John P. Sheehan
*Attorney, Agent, or Firm*—Norman N. Spain

[57] ABSTRACT

In a known method of manufacturing a sintered rare earth transition metal and boron magnet body, e.g. of Nd—Fe—B, the cast alloy is comminuted by hydrogen decrepitation in an atmosphere of pure hydrogen before further comminution, pressing in a magnetic alignment field, sintering and magnetization. The use of pure hydrogen introduces a serious risk of explosion. In the improved method the hydrogen is provided mixed with a chemically non-reactive gas, suitably nitrogen, suitably in a proportion in the range 5 percent to 30 percent by volume of hydrogen, to form an explosion suppressant atmosphere in the decrepitation vessel 1. Sole FIGURE.

17 Claims, 1 Drawing Sheet

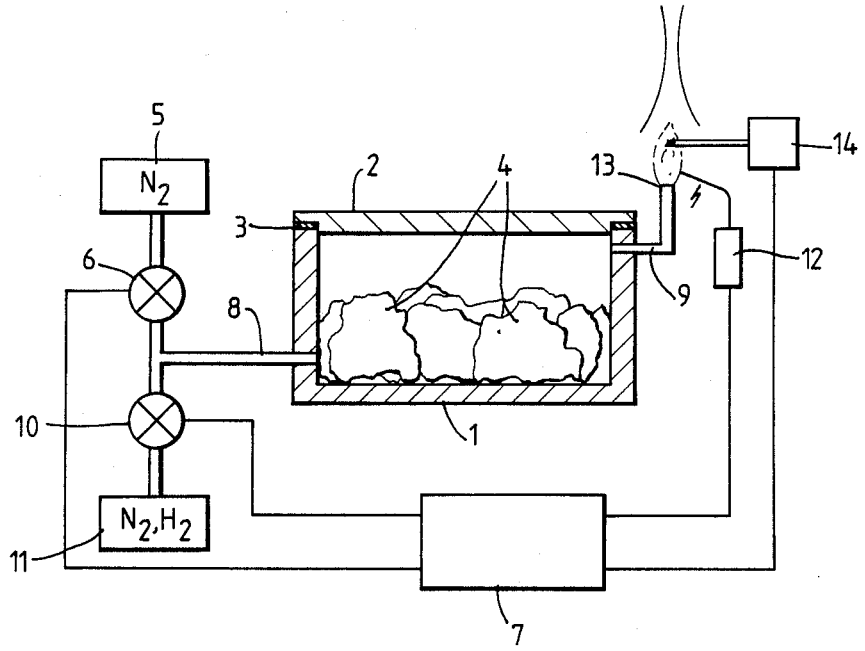
5
$N_2$
2
4
13
14
3
6
12
9
8
10
1
$N_2,H_2$
11
7

METHOD FOR THE MANUFACTURE OF RARE EARTH TRANSITION METAL ALLOY MAGNETS

BACKGROUND OF THE INVENTION

The invention relates to a method of manufacturing a magnet from a magnetic material the main phase of which comprises an intermetallic compound of the rare earth transition metal type which also includes boron, comprising the steps of:

(a) forming an alloy of the constituent rare earth and transition metals with the addition of boron, (b) comminuting the alloy to an average particle size in the range 0.3 to 80 μm and preferably less than about 10 μm, (c) forming a magnet body by pressing the resulting powder in a pressing tool while the powder is situated in a magnetic aligning field, (d) sintering the magnet body at a temperature in the range of about 800 to 1200 degrees C., followed by slow cooling, and (e) after, if necessary, machining to shape, magnetising the magnet body.

The manufacture of such magnets is described in European Patent Application No. 101552.

Magnetic materials based on intermetallic compounds of certain rare earth metals with transition metals may be formed into permanent magnets having coercive fields of considerable magnitude, namely of several hundred kA/m. One method of manufacture includes alloying the constituent materials in an inert atmosphere or in vacuo. The alloy is then comminuted into particles whose average size lies in the range 0.3 to 80 μm and is preferably less than about 10 μm, which are aligned in a magnetic field while being formed into a magnet body by compacting under a pressure of about 10 kN/cm$^2$. The alignment of the particles is fixed and the particles are bonded together by sintering in an inert atmosphere or in vacuo at a temperature in the range of approximately 800 to 1200 degrees C.

Initially, samarium cobalt (SmCo5) magnets were produced, but they were expensive owing to the scarcity of samarium. Recently, however, new types of rare earth transition metal magnets have been devised using the more abundant rare earth metal neodymium in combination with iron and a small proportion of boron. A typical alloy contains a major hard magnetic phase as Nd2Fe14B, and is of the form Nd15Fe77B8. Although such magnet alloys can have slightly varying compositions they will be referred to herein generally by Nd—Fe—B. One form of Nd—Fe—B magnet has been manufactured with a coercivity of approximately 80 kA/m (10 kOe) and an energy product (B.H) of approximately 240 kJ/m3 (30 MGs.Oe).

It should be noted, however, that other rare earth metals, such as for example, praseodymium or dysprosium, which are less abundant than neodymium and niobium, are sometimes substituted for part of the Nd content of such alloys, as is cobalt for part of the iron content. However the designation Nd—Fe—B will be used herein generally to refer to commercially useful neodymium ion boron magnet alloys whether partially substituted or not.

In one method, the manufacture of an Nd—Fe—B magnet commences with the formation of the bulk alloy suitably by induction melting followed by casting, and the resultant bulk ingot is then broken up and comminuted to a fine powder. Initially comminution was effected by firstly stamp milling to a coarse powder of, for example, 35-mesh sieve followed by fine pulverisation in a ball mill for about 3 hours to the required size of, for example, 3 to 10 μm. This process is slow and cumbersome and it has recently been proposed by I.R. Harris et al in the Journal of Less Common Metals 106 (1985), L1 that fairly large pieces of alloy of about 1 to 2 cm3 can be rapidly broken down into a relatively fine powder of particle size less than 1 mm by hydrogen decrepitation using pure hydrogen at room temperature. This can be carried out in a stainless steel hydrogenation vessel and takes the form of an exothermic reaction resulting in the formation of hydrides of the alloy phases. The resultant powder is then further reduced in size by milling in an attritor mill under cyclohexane for about 25 minutes, as described by P. J. McGuiness et al, J of Materials Science 21 (1986), 4107–4110. Alternatively the resultant powder can be jet milled using nitrogen as a propellant.

This manufacturing process suffers certain disadvantages in that hydrogen gas presents a high degree of explosion risk necessitating elaborate industrial precautions. Furthermore the use of cyclohexane in the attritor mill also constitutes a serious fire risk.

SUMMARY OF THE INVENTION

Manufacture can be greatly simplified from the industrial point of view by using for the decrepitation process an explosion-suppressant atmosphere formed by mixing hydrogen with a chemically substantially non-reactive gas, meaning that the gas does not react significantly either with hydrogen or with the constituents of the alloy under the conditions present during decrepitation. Since nitrogen or an inert gas could be used, the atmosphere can be advantageously constituted so that any excess hydrogen can be safely burnt off after passing through the apparatus.

According to the invention, the risk of explosion can be significantly reduced by a method of the kind specified, characterised in that in step (b) the bulk alloy material is comminuted to form a powder by a process of hydrogen decrepitation in an explosion suppressant atmosphere comprising a gaseous mixture of hydrogen and a chemically substantially non-reactive gas. The intermetallic compound can be an Nd—Fe—B alloy and the chemically non-reactive gas is preferably nitrogen. Alternatively or in combination with nitrogen, an inert gas such as argon can be employed, and the explosion-suppressant atmosphere can comprise a proportion of hydrogen in the range of 5 percent to 30 percent by volume.

In a development of the method in accordance with the invention, the alloy powder after decrepitation, is subjected to further comminution by jet milling using a chemically substantially non-reactive propellant gas such as nitrogen or an inert gas, suitably argon, to reduce the powder to the desired size range of 0.3 to 80 μm and preferably to less than about 10 μm.

The process of comminution by hydrogen decrepitation results in the formation of hydrides of the various phases of the alloy which are reasonably stable in air and this effectively reduces oxygen degradation of the magnetic properties of the alloy thus providing some form of passivation during the processes of handling, magnetic alignment and pressing prior to sintering the magnet body. The alloy hydride powder can be magnetically aligned during pressing in a manner similar to that for a magnet body formed of conventionally milled alloy powder. Hydrogen desorption takes place during the initial heating phase of the in-vacuo sintering process and helps to maintain the non-oxidising atmosphere during sintering and subsequent annealing. In the case of an Nd—Fe—B alloy powder it is thought that on heating the hydride most of the hydrogen is desorbed first from an Nd2Fe14B matrix phase in the temperature range 150 to 260 degrees C. while the remaining hydrogen, thought to come from intergranular neodymium-rich material, is released in the temperature range 350 to 650 degrees C. It has been found that in order to provide the magnet body with optimal magnetic properties, the sintering temperature for the alloy hydride powder can be up to 100 C. degrees lower than that for the conventionally milled powder, and to lie in the range 980 to 1080 degrees C.

Thus in the manufacture of magnets of the kind specified, the step of comminution of the bulk alloy by the process of hydrogen decrepitation has certain advantages over the conventional crushing and milling processes hitherto employed in that hydrogen decrepitation is rapid and effective, does not involve the use of heavy machinery in an inert environment, and overcomes a problem caused by hard local regions in the alloy resulting from the presence of free iron in the melt, and which have tended to damage the comminution machinery surfaces or cause the machinery to jam. Furthermore, the powder produced by hydrogen decrepitation does not include the additional undesired distribution of very finely powdered alloy produced by milling, and is generally of a fairly uniform size and flaky constitution enabling a further reduction in particle size to be readily effected. The very friable nature of the hydrogen decrepitated powder enables the capacity of a given jet mill to be greatly increased and almost doubled.

Finally, since the decrepitated alloy powder is in the form of a hydride, it has been found to be relatively non-reactive to the oxygen in dry air and is therefore easier to handle in subsequent process steps. However, it has always been considered that hydrogen decrepitation of magnet alloys of the kind specified had to take place in an atmosphere consisting only of hydrogen of high purity, and this meant that elaborate safety precautions had to be taken to minimise the possiblity of an explosion, thus adding significantly to the cost of production. Consequently, the method in accordance with the invention advantageously enables the beneficial process of hydrogen decrepitation to be employed in the manufacture of magnets of the kind specified with greater safety and at less cost than hitherto.

BRIEF DESCRIPTION OF THE DRAWING

The FIGURE illustrates schematically one form of apparatus in which comminution of an Nd—Fe—B magnet alloy is carried out by hydrogen decrepitation in accordance with the invention.

DETAILED DESCRIPTION OF THE PREFERRED EMBODIMENT

A reaction vessel 1 provided with a lid 2 sealed by a sealing ring 3 and retained by conventional clamps (not shown) is loaded with pieces 4 of Nd—Fe—B bulk alloy castings which can comprise bulk ingots if desired. The lid 2 is then secured and the vessel 1 is purged with pure dry nitrogen gas from a source 5 via a supply valve 6 opened by a controller 7, and an inlet pipe 8. The air contained in the vessel 1 is thereby displaced and is vented via an outlet pipe 9 to the atmosphere.

When purging is complete, a condition which is determined by a time period dependent on the capacity of the vessel 1 and the nitrogen flow rate, the controller 7 closes the nitrogen supply valve 6 and opens a further supply valve 10 connected to a source 11 in the form of a container, suitably one or more gas storage cylinders, in which an explosion suppressant atmosphere comprising a gaseous mixture of hydrogen and a chemically substantially non-reactive gas, suitably nitrogen, is contained under pressure. In the present example the mixture comprises 75 percent by volume of nitrogen gas and 25 percent by volume of hydrogen gas and this is then passed via the inlet 8 into the vessel 1 to displace the pure nitrogen and to initiate, via the hydrogen component thereof, the hydriding reaction and consequent decrepitation of the pieces 4 of bulk Nd—Fe—B alloy. The controller 7 also, possibly after short delay, initiates the operation of an ignition device 12 which periodically applies a spark in the vicinity of the open end 13 of the venting tube 9 so as to ignite the hydrogen component of the gaseous mixture when it emerges into the atmosphere. A thermocouple device 14 senses the presence of flame and this is signalled to the controller 7 which the turns off the ignition device. As a safety precaution, the controller 7 continually monitors the presence of flame at the vent 13 via the thermocouple 14 and is arranged to turn off the supply valve 10 if the flame signal from the thermocouple 14 disappears at any time. The controller 7 also turns off the valve when starting up if a flame signal fails to appear within a given time from initiating the flow of the gaseous mixture.

The flow rate of the gaseous mixture via the supply valve 10, is regulated so that the decrepitation reaction in the hydrogenation vessel 1 proceeds relatively quickly while ensuring that the temperature of none of the alloy pieces 4 approaches 300 degrees C. at which temperature disproportionation of the alloy can occur with the generation of very finely divided iron.

When the process of decrepitation is judged to be sufficient, for example by a given decrease in the amount of heat generated, the controller 7 closes the supply valve 10 to stop the supply of gaseous mixture and opens the supply valve 6 to cause the vessel 1 to be purged with pure nitrogen gas to remove the gaseous mixture therefrom after which the flame at the end 13 of the vent will extinguish. The lid 2 is then opened and the powdered alloy removed for subsequent processing.

After the process of premilling by hydrogen decrepitation, the alloy powder will have a particle size of less than about 1 mm across and will have a flake-like structure. The premilled powder can then be milled in conventional manner in an attritor mill under cyclohexane and dried prior to forming the magnet bodies, or it can be jet milled. However, cyclohexane is inflammable necessitating elaborate precautions and it is therefore preferable that the further comminution of the alloy powder sould be carried out by the process of jet milling using a chemically non-reactive propellant gas, preferably nitrogen, although an inert gas such as argon can alternatively be employed. In this process a high velocity stream of propellant gas is directed into a vessel containing the alloy powder so that the particles are subjected to mutual collisions with one another and with the wall of the vessel and are reduced to the desired size in the range of 0.3 to 80 $\mu$m.

The hydrided alloy powder is then formed into a magnet body by feeding the powder into a suitably shaped pressing chamber in a pressing tool, through which a magnetic aligning field is applied while the powder is compacted under a pressure of about 10 kN/cm2. The hydride powder can be pressed and magnetically aligned in a manner similar to the ordinary milled powder but has the advantage of being less reactive in the presence of oxygen in dry air, although it is advisable to maintain it in a substantially oxygen-free non-reactive or inert atmosphere to avoid any oxygen uptake, including at the pressing stage. The magnetic alignment process can conventionally employ electromagnets but preferably can use high energy permanent magnets, suitably Nd—Fe—B magnets as described and claimed in U.K. Patent Application Number 8625099.

An advantage of premilling by hydrogen decrepitation is that no demagnetising field is required after the magnet bodies have been aligned and pressed.

After pressing, the magnet bodies are transferred to a vacuum furnace and heated in vacuo, initially to desorb the hydrogen, and then to sinter the magnet body at a temperature in the range 980 to 1080 degrees C. and preferably at about 1040 degrees C., the sintering temperature being maintained for about one hour after which the magnet body is annealed by allowing it to cool slowly. The sintered magnet body is then machined to shape, if necessary, and magnetised in a strong magnetic field of, for example, about 2400 kA/m.

The constitution of the explosion suppressant atmosphere containing hydrogen used for decrepitation in accordance with the invention, can if desired, be different from that of the specified gaseous mixture, and the proportion of hydrogen can be selected in the range 5 percent to 30 percent by volume. It is preferable from the point of view of safety in the factory and therefore of realising the full advantages of the invention, that the explosion suppressant atmosphere containing hydrogen should be supplied already mixed in containers in order to form the source 11.

It should be noted that it is also possible to realise some advantage, in accordance with the invention, in the form of an improvement in safety over the use of pure hydrogen in the reaction vessel 1, by mixing individual flows of hydrogen and nitrogen gas in the proportion of not more than 30 percent of hydrogen by volume, before passing the mixture into the vessel via the inlet 8. In this case, however, further controls and safety measures would be required to ensure that the proportion of hydrogen does not exceed a safe limit of about 30 percent by volume.

I claim:

1. A method of manufacturing a magnet from a magnetic material the main phase of which comprises an intermetallic compound of at least one rare earth metal and at least one transition metal and boron, comprising the steps of:

(a) forming a bulk alloy material of the constituent rare earth and transition metals with the addition of boron, (b) comminuting the bulk alloy material to form a powder by the process of hydrogen decrepitation in an explosion suppressant atmosphere comprising a gaseous mixture of hydrogen and a chemically substantially non-reactive gas, (c) further comminuting the resultant hydride powder to an average particle size in the range of 0.3 to 80 μm.

(d) forming a magnet body by pressing the further comminuted resultant hydride powder in a pressing tool while said hydride body is situated in a magnetic aligning field, (e) dehydrogenating and sintering, in vacuo the magnet body at a temperature in the range of about 800 to 1200 degrees C. followed by slow cooling, and (f) after, if necessary, machining to shape, magnetising the magnet body.

2. A method as claimed in claim 1, characterised in that the intermetallic compound is an Nd—Fe—B alloy.

3. A method as claimed in claim 2, characterised in that in the intermetallic compound, neodymium is partially substituted by at least one other rare earth element.

4. A method as claimed in claim 3 characterized in that said other rare earth element is selected from the group consisting of praseodymium and dyprosium.

5. A method as claimed in claim 1, characterised in that in the intermetallic compound, iron is partially substituted by cobalt.

6. A method as claimed in claim 1, characterised in that the explosion suppressant atmosphere contains a proportion of hydrogen lying in the range 5 percent to 30 percent by volume.

7. A method as claimed in claim 1, characterised in that the chemically non-reactive gas is nitrogen.

8. A method as claimed in claim 7, characterised in that the explosion suppressant atmosphere comprises 25 percent by volume of hydrogen and 75 percent by volume of nitrogen.

9. A method as claimed in claim 1, characterised in that the chemically non-reactive gas is an inert gas.

10. A method as claimed in claim 9, characterised in that the inert gas is argon.

11. A method as claimed in claim 1, characterised in that the explosion suppressant atmosphere containing hydrogen is supplied from a container in which said atmosphere is contained under pressure.

12. A method as claimed in claim 1, characterised in that the hydride powder formed by hydrogen decrepitation is further comminuted by jet milling using a chemically substantially non-reactive propellant gas.

13. A method as claimed in claim 12, characterised in that the propellant gas is nitrogen.

14. A method as claimed in claim 12, characterised in that the propellant gas is argon.

15. A method as claimed in claim 1, characterised in that the step (e) is carried out in vacuo at a temperature in the range 980 to 1080 degrees C.

16. A method as claimed in claim 15, characterised in that the sintering temperature is 1040 degrees C.

17. A method as claimed in claim 1, characterized in that in step (c) the resultant hydride powder from step (b) is comminuated to an average particle size of less than 10 μm.

* * * * *